US005662716A

United States Patent [19]

Sun

[11] Patent Number: 5,662,716

[45] Date of Patent: Sep. 2, 1997

[54] PROCESS FOR INCREASING STAIN-RESISTANCE OF CATIONIC-DYEABLE MODIFIED POLYAMIDE FIBERS

[75] Inventor: Yanhui Sun, Wilmington, Del.

[73] Assignee: E. I. du Pont de Nemours and Company, Wilmington, Del.

[21] Appl. No.: 653,897

[22] Filed: May 28, 1996

[51] Int. Cl.[6] ..... D06P 3/00; D06P 1/39

[52] U.S. Cl. ..... 8/539; 8/618; 8/620; 8/673; 8/680

[58] Field of Search ..... 8/539, 618, 620, 8/673, 680

[56] References Cited

U.S. PATENT DOCUMENTS

| | | | |
|---|---|---|---|
| 4,043,749 | 8/1977 | Huffman | 8/1 XB |
| 4,579,762 | 4/1986 | Ucci | 428/95 |
| 5,030,246 | 7/1991 | Chao | 8/618 |
| 5,085,667 | 2/1992 | Jenkins | 8/539 |
| 5,164,261 | 11/1992 | Windley | 428/364 |
| 5,199,958 | 4/1993 | Jenkins | 8/539 |
| 5,350,426 | 9/1994 | Jenkins | 8/539 |
| 5,354,342 | 10/1994 | Jenkins | 8/481 |
| 5,466,527 | 11/1995 | Jenkins | 428/375 |
| 5,468,554 | 11/1995 | Windley | 428/357 |

FOREIGN PATENT DOCUMENTS

| | | |
|---|---|---|
| 36 32 795 C2 | 6/1988 | Germany . |
| 1161411 | 8/1969 | United Kingdom . |

OTHER PUBLICATIONS

Trotman, E.R, Dyeing and Chemical Technology of Textile Fibres, 1984, p. 336–347.

*Primary Examiner*—Margaret Einsmann

[57] ABSTRACT

This invention relates to an improved process for dyeing cationic-dyeable polyamide fibers, especially carpet fibers, with an acid dye to provide stain-resistant fibers. The polyamide fibers contain cationically dyeable sulfonate groups along the polymer chain. The improvement involves adding certain water-soluble salts to a dyebath at a concentration of at least 20% based on the weight of fiber.

7 Claims, No Drawings

PROCESS FOR INCREASING STAIN-RESISTANCE OF CATIONIC-DYEABLE MODIFIED POLYAMIDE FIBERS

BACKGROUND OF THE INVENTION

1. Field of the Invention

This invention relates to an improved process for preparing stain-resistant polyamide fibers, especially carpet fibers, containing cationically-dyeable sulfonate groups along the polyamide polymer chain, wherein the fibers have been dyed with an acid dyestuff.

2. Description of the Related Art

As known in the art, polyamide fibers can be made to resist staining by acid dyes by copolymerizing in the polyamide polymer a small percentage of a cationically dyeable monomer such as an aromatic sulfonate, for example, 1 to 4 weight percent of the sodium salt of 5-sulfoisophthalic acid. In Ucci, U.S. Pat. No. 4,579,762 nylon 6 and nylon 6,6 carpet fibers formed from polymers having aromatic sulfonate units in the polymer chain and having improved stain-resistance to acid dyes are disclosed.

From Windley, U.S. Pat. Nos. 5,164,261 and 5,468,554, it is further known that such cationic-dyeable modified polyamide fibers can be made more stain-resistant upon being dyed with at least 0.0048 weight percent of an acid dyestuff. However, under some circumstances, especially when it is desirable to dye such fibers to only a light shade, it has been found that maximum stain-resistance (i.e., no staining) may not be obtained.

Chao, U.S. Pat. No. 5,030,246 discloses a process for continuously dyeing polyamide fibers which do not contain cationic-dyeable monomeric units in the polymer chain. Rather, the fibers are coated with a stainblocking agent which may contain aromatic sulfonate groups. The fibers can be acid dyed to a deeper shade by adding certain ammonium and metal salts to the dye liquor (typically in an amount from 0.2 to 8% based on the weight of the fiber). Chao discloses that effective salts include salts of lithium,.calcium, and magnesium, as well as certain ammonium, sodium and potassium salts. The use of the salts results in greater uptake of the dyestuff from the dye liquor onto the fibers, and the excess dye not taken up by the fibers is subsequently rinsed off with water.

In Jenkins, U.S. Pat. No. 5,466,527, cationic dyeable nylon fibers containing a sufficient amount of $SO_3H$ groups or COOH groups within the polymer structure to render the nylon fiber dyeable with cationic dyes are disclosed. A process for improving the stain-resistance, lightfastness, and ozone-resistance of such fibers is disclosed, wherein the fibers are dyed with level acid dyes or premetallized acid dyes at a pH value less than 7.0. In Example 6 (columns 13–14), a carpet made with cationic dyeable nylon fiber is described as being dyed in a dyebath containing level acid dyes or premetallized acid dyes and 2% sodium sulfate (Glauber salt) based on weight of fiber. Tables I and II in Example 6 show that an improvement in dye exhaustion levels is obtained when 2% sodium sulfate is added to the dyebath over dye exhaustion levels obtained from dyebaths which do not contain sodium sulfate. Thus, it is known from Jenkins that sodium sulfate can be added to a dyebath and better exhaustion of the acid dye onto the fiber can be obtained. However, it would be desirable to have a process for acid dyeing cationic-dyeable modified polyamide fibers, wherein the stain-resistance of the fibers can be improved.

The present invention provides such a process. Particularly, it has now been discovered that when certain salts are included in the acid dyebath at certain concentrations, the stain-resistance of the acid dyed fibers is improved. The stain-resistance of the acid dyed fibers is improved without having to increase the dye content on the fiber..

SUMMARY OF THE INVENTION

The present invention provides an improved process for dyeing polyamide fibers with an acid dyestuff in a dyebath, wherein the fibers comprise a polyamide copolymer which contains cationic-dyeable aromatic sulfonate salt group substituents along the polymer chain. The improvement comprises adding a water-soluble salt selected from the group consisting of ammonium, potassium, and sodium salts, and mixtures thereof to a dyebath at a concentration of at least 20% based on the weight of the fiber to produce acid dyed fibers having a stain-resistance rating of at least 8.0 on the AATCC Red 40 Scale.

Preferably, the salt is selected from the group consisting of sodium and potassium chlorides; sodium, potassium, and ammonium sulfates; and sodium acetate. In some instances, the concentration of salt in the dyebath may be at least 100% based on weight of fiber. The acid dye may be a premetallized acid dye. The fibers may be acid dyed at a pH level greater than 6.5, although such a pH level is not necessary. Suitable polyamide copolymers for use in this invention include copolymers containing 1 to 4 weight percent of monomer units derived from a salt or other derivative of 5-sulfoisophthalic acid based on the final weight of the copolymer. The polyamide copolymer may also contain units selected from the group consisting of polyhexamethylene adipamide units, poly-ε-caprolactam units, and mixtures thereof.

DETAILED DESCRIPTION OF THE INVENTION

As known in the art, polyamide fibers can be visibly and permanently stained when left in contact with a solution containing acid dyes typically used as colorants for foodstuffs. Those skilled in the art have developed different methods for rendering polyamide fibers stain-resistant. For example, in the foregoing Windley, U.S. Pat. Nos. 5,164,261 and 5,468,554, the entire disclosures of which are hereby incorporated by reference, the polyamide fibers are rendered stain-resistant by copolymerizing in the polyamide polymer a cationic dye modifier and by adding an acid dye to the polymer melt or by dyeing the fibers with an acid dye from a dyebath. The present invention is an improvement over the process disclosed in the foregoing patents and involves adding certain salts to the dyebath which selectively improve the stain-resistance of the dyed fibers without the need for increasing the dyestuff content on the fiber.

More particularly, this invention provides an improved process for dyeing polyamide copolymer fibers containing a cationic dye modifier with an acid dye, producing dyed fibers which, when dried, have a stain-resistance rating of at least 8.0, preferably 9.0, on the AATCC Red 40 Stain Scale. The term, "acid dye" includes premetallized acid dyes. The improved process is accomplished by dyeing the cationic dyeable fibers with an acid dye in a dyebath which contains salt at a concentration to provide at least 20% salt based on the weight of fibers (% owl) being dyed. The process is particularly advantageous for fabrics which are dyed to light or medium shades. It is presumed that the improvement is equally effective for fibers dyed to deep shades, but stains are less evident on deep-dyed fibers, so the improvement is difficult to evaluate. The term "fiber" includes both continuous (e.g., bulked continuous filament) and short lengths (e.g., staple). Effective salts are ammonium, sodium and potassium salts, or combinations of any of these salts, at a concentration of at least 20% based on weight of fiber. When these salts are used in accordance with this invention, dyeing with acid dyes takes place rapidly and there is no need to adjust the pH of the dyebath at any stage of the dying process. These acid-dyed cationically-modified polyamide fibers have greater stain-resistance than cationically-modified polyamide fibers which have been dyed in a dyebath which does not contain these salts.

Cationic Dyeable Modified Polyamides

The cationic dye modifier used to form the polyamide copolymers useful in this invention have the formula:

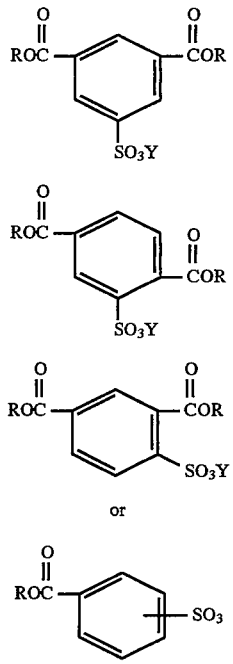

where Y is H, Li, Na, K, or Cs and R is H or an alkyl group containing 1 to 5 carbon atoms. The —OR groups are lost during polymerization. The preferred cationic dye modifiers are those containing two carboxyl groups with 5-sulfoisophthalic acid being especially preferred. Generally, sufficient cationic dye modifier is used to produce a copolymer containing from 1 to 4 weight percent (wt. %) of cationic dye modifier based on the final polymer weight of the polyamide copolymer with from 2 to 3 wt. % being the preferred range.

The polyamide copolymers useful in this invention can be prepared by blending the salt of the base polyamide (e.g., nylon 6,6 salt or caprolactam) with the cationic dye modifier followed by polymerizing the blended composition in an autoclave using standard polymerization procedures, solidifying and fragmenting the polymer, increasing the degree of polymerization by further polymerizing the polymer in the solid phase while simultaneously super-drying the polymer, and further polymerizing the polymer in the molten state. In a preferred embodiment used for production of carpet fibers, the copolymer is prepared by polymerizing nylon 6,6 salt containing sulfonate modifier in an autoclave to a relative viscosity of about 35, increasing the relative viscosity to about 45 to 65 by solid-state polymerization while super-drying the polymer, and melting the polymer in a screw extruder, transfer line and spin block to produce a copolymer with a relative viscosity between 45 and 70. In the production of textile fibers, the acceptable relative viscosity can be lower (about 35 to 45). Preferably, the copolymers used in this invention contain from 20 to 40 amine ends per $10^6$ grams of copolyamide.

Dyeing Procedure

A dyebath is prepared by adding the desired amount of acid dye and salt to water. Dye concentrations can vary from 0.01 to 0.05%, based on weight of fiber. The salt concentration must be sufficiently high to exhaust the dyestuff from the dyebath onto the fiber. As stated earlier, it has been found that this salt concentration must be at least 20%, based on weight of fiber (% owf), and can be as high as 200%, or even higher, for the salts which are useful in this invention. The fibers may be dyed at a pH level greater than 6.5, but such a pH level is not necessary. If desired, a lower pH level can be used.

The results reported in the following examples were obtained by placing 10 grams of fiber in 200 ml of dyebath containing 0.0037 grams of dye and salt at various concentrations. The dyebath was heated to boiling in the shortest possible period and held at the boil for 5–30 minutes, usually about 10 minutes. The dyebath was then cooled to 70°–80° C. Cold water may be added to accomplish the cooling. The fibers were removed, washed and dried, either at room temperatures or by heating. The fibers were dyed to a light gray shade. Comparable results were obtained with fibers dyed to dune and beige shades. Equivalent results were obtained for fibers in the form of yarns, or woven, knitted, or pile fabrics. This procedure can be readily adapted to a continuous process.

The following examples are illustrative of this invention but should not be construed as limiting the scope of the invention.

TEST METHODS

Stain Test Method

The following test procedure was used to determine the stain-resist performance of the fiber samples.

A solution of staining agent was prepared by dissolving 45 grams of cherry-flavored, sugar-sweetened "Kool-Aid" premix powder in 500 cc. of water. The solution allowed to reach room temperature, i.e., 75° F.±5° F. (24° C.±3°), before using. The colorant used in the "Kool Aid" solution was Red Acid Dye 40.

A specimen, approximately 1.5×3 inches (3.8×7.6 cm.) for carpet samples and approximately 2×4 inches (5.1×10.2 cm.) for knitted fabrics was cut from each sample and placed on a flat non-absorbent surface. The solution of staining agent was poured onto each specimen through a cylinder to form a 1 to 2 inch (2.5 to 5.1 cm.) circular stain, using 20 cc. for carpet samples and 10 cc. for textile samples. The samples were lagged in the laboratory for twenty-four hours and then rinsed thoroughly with cool tap water and squeezed dry, using an extractor to remove excess solution.

The stain-resistance of the specimen was determined visually according to the color left on the stained area of the sample. The color depth was determined by comparison with a series of ten transparent plastic rectangles in accordance with the AATCC Red 40 Stain Scale, in which 10 represents no staining, 9 very light staining, with increasing color as the scale decreases to 1, which represents heavy staining.

In each of the following examples, 200 ml. of dyebath and 10 grams of fiber sample were used. Concentrations of salt and dye are expressed as percentages based on the weight of fiber (% owf). The same weight of dye (0.0037 gram) was used in each example. In all but one of the examples, the cationic dyeable polyamide copolymer contained 3% by weight of 5-sulfoisophthalate. The dyed samples were light gray in color. The dye formulation was composed of the following ingredients: 0.015% owf Tectilon yellow 3R KWL 200 (acid yellow 246), 0.0075% owf Tectilon red 2B KWL 200 (acid red 361), and 0.005% owf Tectilon blue 4RS KWL 200. The pH levels of the solutions were measured with a Fisher Accumet pH Meter Model 610A equipped with a Fisher glass electrode.

EXAMPLES

Fiber Preparation

A polyamide copolymer was prepared by blending nylon 6.6 salt and the sodium salt of 5-sulfoisophthalic acid and polymerizing in an autoclave. The polymer melt was solidified, fragmented, and polymerized further in the solid state in an inert atmosphere at a temperature of 185° C. The copolymer was then fed to a twin screw extruder and discharged into a transfer line at a temperature of 290° C. It was extruded through a spinneret to produce yarns in which each of 128 filaments had four symmetrically-placed voids. After application of finish, the yarns were drawn 2.7× at 190° C. in a continuous process. The drawn filaments were passed through a jet where they were impinged with air at 240° C. and 120° C. and collected on a screen drum. The yarn was removed by a take-up roll and wound onto tubes. The knitted and tufted fabrics used in the following Examples were prepared from these yarns.

EXAMPLE 1

Certain salts, such as calcium salts, are effective in exhausting the dyestuff from the dyebath onto the fiber at low and high salt concentrations. However, the stain-resistance of fiber samples dyed to light and medium shades by methods using such salts is unacceptable, as shown in Table 1. In comparison, the process of this invention employs certain salts at a concentration of at least 20% on weight of fiber (% owf) and provides fibers having good stain-resistance, as shown in Table 1.

TABLE 1

| Salt | | pH of | % Dyestuff on | Stain |
|---|---|---|---|---|
| Composition | % OWF | Soln | Fiber | Rating |
| *$Ca(H_2PO_4)_2$ | 2 | 5.3 | 0.037 | 6.0 |
| *$Ca(H_2PO_4)_2$ | 20 | 5.3 | 0.037 | 6.0 |
| *$(NH_4)_2SO_4$ | 10 | 7.2 | Less than 0.037 | 7.0 |
| *$Na_2SO_4$ | 10 | 7.8 | Less than 0.037 | 6.0 |
| $Na_2SO_4$ | 20 | 7.4 | Less than 0.037 | 8.0 |
| $(NH_4)_2SO_4$ | 40 | 6.8 | 0.037 | 8.0 |

*Comparative Examples

EXAMPLE 2

When the salts of this invention are used in the dyebath at concentrations above 20%, based on weight of fiber (% OWF), they are effective in imparting even greater stain-resistance to cationic-dyeable modified polyamide fibers which are dyed with an acid dyestuff. Such fibers are made from polyamide copolymer containing 2% and 3% 5-sulfoisophthalate. This effect is illustrated in Table 2 for polyamide fibers taken from knitted fabrics which have been dyed to a light gray color, wherein the fibers are made from polyamide copolymer containing 2% and 3% 5-sulfoisophthalate.

TABLE 2

| % Sulfoisoph- | Salt | | | % Dyestuff | Stain |
|---|---|---|---|---|---|
| thalate | Composition | % OWF | pH | on Fiber | Rating |
| 2 | NaCl | 185 | 7.4 | 0.037 | 9.0 |
| 3 | KCl | 185 | 7.4 | 0.037 | 9.0 |

EXAMPLE 3

The process of this invention is useful for dyeing and imparting good stain-resistance to the above-described polyamide fibers in any form e.g., yarns or nonwoven, knitted, woven or pile fabrics. This effect is illustrated in Table 3 for fibers dyed to a light gray shade.

TABLE 3

| | Salt | | | % Dyestuff | Stain |
|---|---|---|---|---|---|
| Substrate | Composition | % OWF | pH | on Fiber | Rating |
| Yarn | NaCl | 200 | 7.4 | 0.037 | 9.0 |
| Knitted Fabric | NaCl | 185 | 7.4 | 0.037 | 9.0 |
| Pile Fabric (carpet) | $(NH_4)_2SO_4$ | 40 | 6.8 | 0.037 | 8.0 |

EXAMPLE 4

The data in Table 4 illustrate the unique effectiveness of the sodium and potassium salts for producing polyamide fibers which have good stain-resistance after being dyed with the above-described dyes, as compared to similar salts of lithium, magnesium, zinc, and calcium. All of the polyamide fibers were made from copolymers containing 3% by weight of 5-sulfoisophthalic acid and were dyed to a light gray shade. The tests were run on fabric taken from knitted socks.

TABLE 4

| Salt | | | | Stain |
|---|---|---|---|---|
| Composition | % OWF | pH | % Dyestuff on Fiber | Rating |
| $Na_2SO_4$ | 200 | 7.4 | 0.037 | 9.0 |
| $K_2SO_4$ | 200 | 7.9 | 0.037 | 9.0 |
| *$Li_2SO_4$ | 200 | 8.3 | 0.037 | 6.0 |
| *$MgSO_4$ | 200 | 7.3 | 0.037 | 6.0 |
| *$ZnSO_4$ | 200 | 6.8 | 0.037 | 6.0 |
| *$Ca(H_2PO_4)_2$ | 20 | 5.3 | 0.037 | 6.0 |
| $Na_2SO_4$ | 185 | 7.8 | 0.037 | 9.0 |
| NaOAc | 110 | 7.8 | 0.037 | 9.0 |
| KCl | 185 | 7.4 | 0.037 | 9.0 |

*Comparative Examples

I claim:

1. An improved process for dyeing polyamide fibers with an acid dyestuff in a dyebath, wherein the fibers comprise a polyamide copolymer which contains cationic-dyeable aromatic sulfonate salt group substituents along the polymer chain, and wherein the improvement comprises adding a water-soluble salt selected from the group consisting of ammonium, potassium, and sodium salts, and mixtures thereof to the dyebath at a concentration of at least 20% based on the weight of the fiber to produce acid dyed fibers having a stain-resistance rating of at least 8.0 on the AATCC Red 40 Stain Scale.

2. The process of claim 1, wherein the salt is selected from the group consisting of sodium and potassium chlorides; sodium, potassium, and ammonium sulfates; and sodium acetate.

3. The process of claim 2, wherein the concentration of salt in the dyebath is at least 100% based on the weight of the fibers.

4. The process of claim 1, wherein the acid dye is a premetallized acid dye.

5. The process of claim 1, wherein the fibers are dyed at a pH level greater than 6.5.

6. The process of claim 1, wherein the polyamide copolymer contains 1 to 4 weight percent of monomer units derived from a salt, or other derivative of 5-sulfoisophthalic acid based on the final weight of the copolymer.

7. The process of claim 1, wherein the polyamide copolymer contains units selected from the group consisting of polyhexamethylene adipamide units, poly-ε-caprolactam units, and mixtures thereof.

* * * * *